US005329298A

United States Patent [19]

Hong et al.

[11] Patent Number: 5,329,298

[45] Date of Patent: Jul. 12, 1994

[54] THERMAL PRINT HEAD

[75] Inventors: Eun-Tak Hong; Hong-Geun Yang, both of Seoul; Bae-Won Lee, Suwon, all of Rep. of Korea

[73] Assignee: SamSung Electronics Co., Ltd., Suwon, Rep. of Korea

[21] Appl. No.: 920,642

[22] Filed: Jul. 28, 1992

[30] Foreign Application Priority Data

Aug. 19, 1991 [KR] Rep. of Korea ..... 14268/1991

[51] Int. Cl.[5] ..... B41J 2/335

[52] U.S. Cl. ..... 346/76 PH

[58] Field of Search ..... 346/76 PH

[56] References Cited

U.S. PATENT DOCUMENTS 4,571,598 2/1986 Shindzaki et al. ..... 346/76 P H

FOREIGN PATENT DOCUMENTS 0225970 12/1984 Japan ..... 346/76 P H
0238761 10/1987 Japan ..... 346/76 P H
0230963 10/1991 Japan ..... 346/76 P H

*Primary Examiner*—Benjamin R. Fuller
*Assistant Examiner*—Huan Tran
*Attorney, Agent, or Firm*—Robert E. Bushnell

[57] ABSTRACT

A thermal print head includes a boat on which the substrate, driving IC and printed circuit board are mounted, the boat being mounted on a heat sink which material and shape are changeable according to the mechanical change of the system.

5 Claims, 3 Drawing Sheets

THERMAL PRINT HEAD

BACKGROUND OF THE INVENTION

The present invention relates generally to a thermal print head and more particularly to a thermal print head wherein a driving integrated circuit (IC) and a printed circuit board (PCB) are manufactured on a boat instead of on a heat sink.

A thermal print head converts electric information to thermal energy to record the information on a recording media such as thermal recording paper by discoloring the recording media according to the electric information.

Referring to FIG. 1, a conventional thermal print head is illustrated. As shown in the drawing, the conventional thermal print head includes a substrate 5 on which a heating element 2 and a number of driving ICs 7 for driving the heating element 2 by providing thereto an electric signal are mounted, a PCB 10 for providing the electric signal to the driving IC 7, and a number of gold wires 6 for connecting the driving ICs 7 with the electric signal generated from the PCB 10. The substrate 5 and the PCB 10 are commonly mounted on a heat sink 4. The PCB 10 is electrically connected to the heating element 2 through a common electrode 1 and a number of individual electrodes 3. It is necessary that the substrate 5 on which the heating element 2 is to be mounted should be made of a material which is stable against the high temperature and the chemical reaction during the manufacturing process. Generally, a material containing 96% or over 96% of Alumina $Al_2O_3$ is used to make the substrate 5. Glaze of 60 μm thick is coated uniformly on the alumina substrate to effectively charge and discharge the heat generated from the heat element 2 according to the current flow on the substrate. A resistive film with a specific resistance is formed on the glaze layer to generate the heat according to the current flow. The resistive film is about 1000Å thick. A wiring layer (usually made of aluminum) through which the electric current flows is formed on the resistive film. The heating element and the electric wiring circuit having a specific shape are then formed by means of the photo-etching technique which is generally used for manufacturing the semiconductor devices. In order to prevent the oxidization of the heating element and the abrasion of the heating elements due to the contact with the recording media such as a thermal recording paper, a single layer of nitride-silicon or a double layer made of an oxide layer and a titanium layer is coated around the heating elements and the wirings. Alternatively, the sputtering or CVD (chemical vapor deposition) method can be used for forming the films. The foregoing processes will conclude the manufacture of the heating elements.

Referring to FIG. 2, shown is a cross sectional view of a conventional thermal print head which is manufactured by a gold wiring connection technique. It is shown in the drawing that the substrate 5 on which the driving IC 7 and the heating element 2 are mounted, and the PCB 10 are mounted on the heat sink 4 and those are electrically connected to each other by a gold wiring connection technique. Further, the driving IC 7 and the gold wire 6 are covered by resinoid 12 and 13 (preferably silicon rubber) thereby to protect the gold wire 6 from external phenomenon and vibration. Finally, a protection cap 14 for protecting the gold wire 6 and the driving IC 7 from the external impact, a connector 9 for connecting the electric signals, the heat sink 4, a thermistor (not shown) for measuring the circumference temperature, and a condenser (not shown) for preventing the external noises are assembled together to complete the manufacture of the thermal print head.

Another conventional method for manufacturing the thermal print head has been proposed. According to the method, after a driving IC is mounted on a substrate on which a heating element is formed, electrical connections between the substrate and the driving IC are all made on the substrate. Thereafter, by use of a flexible PCB, the driving IC is connected with the external signals.

In the case of the thermal print head according to the former technique in which the substrate on which the heating elements and the driving IC are formed, and the driving PCB are assembled on the heat sink, the heat sink plays a role of a mechanical fixing media which fixes the thermal print head on a system, the shape and material of the heat sink must be changed according to the system to which the thermal print head is to be installed. Therefore, the method for manufacturing the thermal print head has to be changed according to the shape and material of the heat sink and there was a problem that different types of jigs must be prepared for the different systems. On the other hand, in the case that the electrical connections are all embodied on a substrate on which the heating element are formed, although the manufacturing method is more adaptable to the mechanical change of the system, the size of the substrate becomes as large as the size of the driving IC and the electric wiring portion thereby results in increasing the cost for manufacturing the thermal print head.

SUMMARY OF THE INVENTION

It is accordingly an object of the present invention to provide a thermal print head which is readily manufacturable regardless of the mechanical change of a system on which the thermal print head is to be installed.

According to an aspect of the present invention, a thermal print head includes a boat on which the substrate, driving IC and printed circuit board are mounted, the boat being mounted on the heat sink which material and shape are changeable according to the mechanical change of the system.

BRIEF DESCRIPTION OF THE ACCOMPANYING DRAWINGS

For a better understanding of the invention and to show how the same may be carried into effect, reference will now be made, by way of example, to the accompanying diagrammatic drawings, in which.

DETAILED DESCRIPTION OF THE INVENTION

Figure 1:
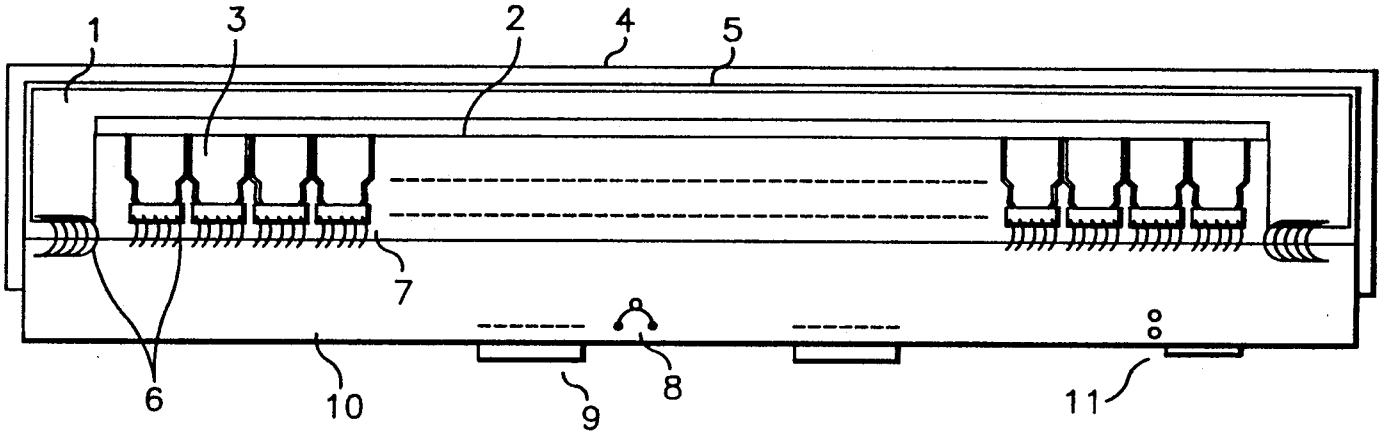
FIG. 1 shows a plan view of a conventional thermal print head.
Figure 2:
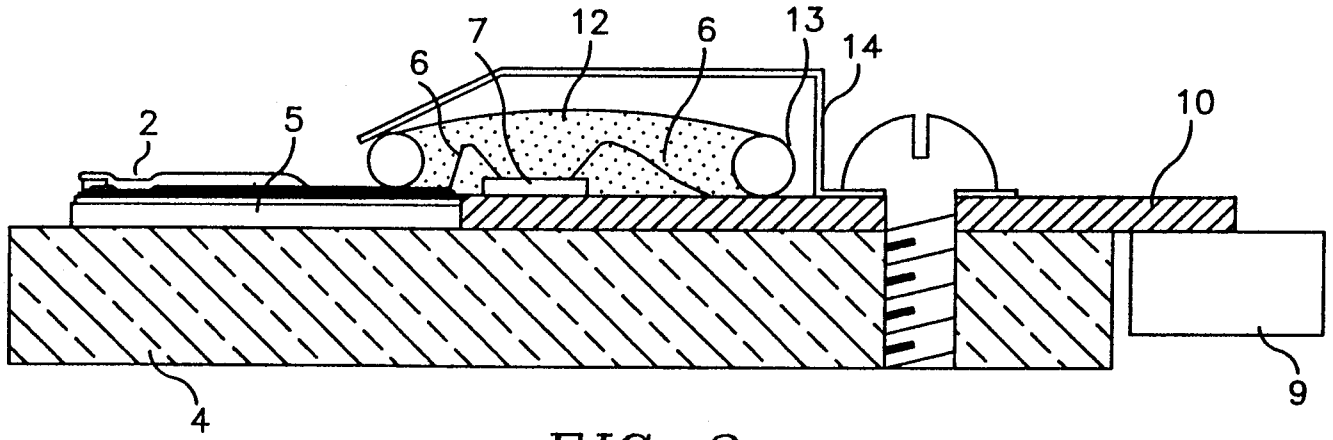
FIG. 2 shows cross sectional view of the conventional thermal print head of FIG. 1.
Figure 3:
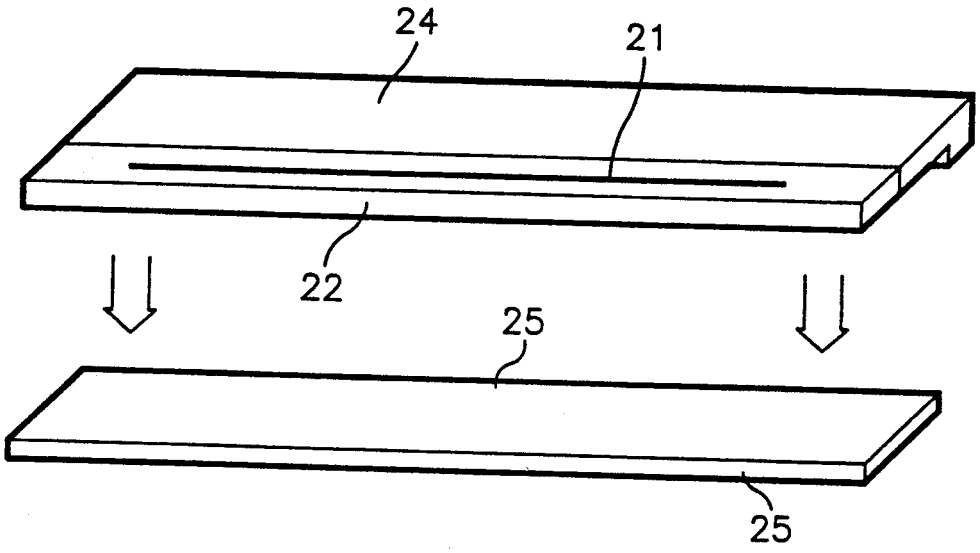
FIG. 3 shows a process diagram of manufacturing a primary assembly of the thermal print head according to the present invention.
Figure 4:
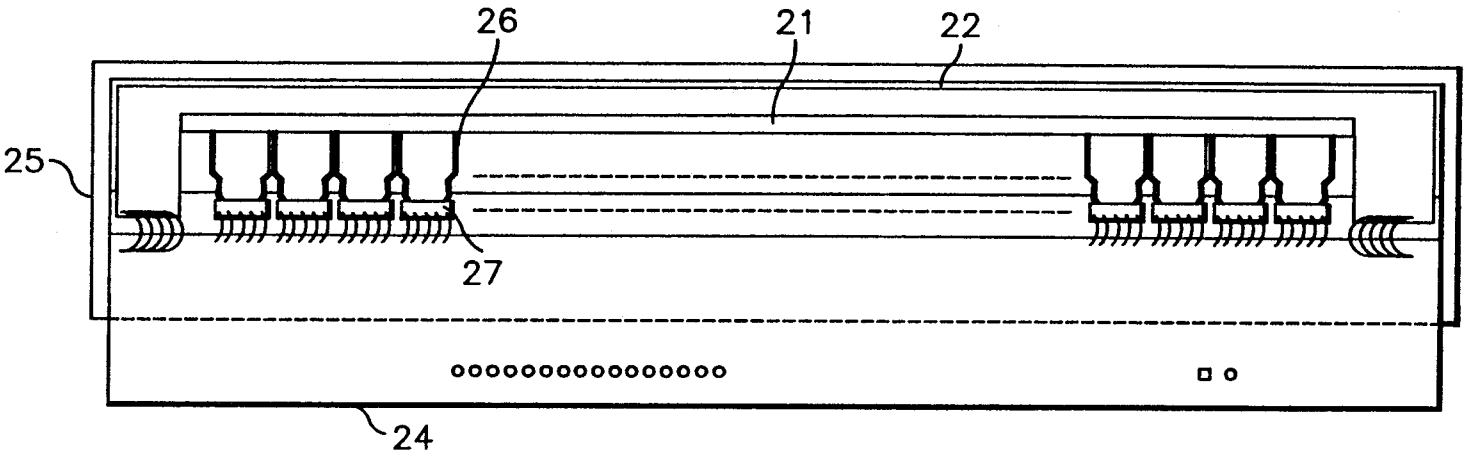
FIG. 4 shows a plan view of the primary assembly of the thermal print head according to the present invention.

Referring to FIGS. 3 and 4, a thermal print head according to the present invention is manufactured such that a substrate 22 on which a heating element 21 is formed, a driving IC 27, and a PCB 24 are mounted on a specific area of a boat 25 and they are electrically connected to each other by gold wires. Thereafter, silicon resinoid covers driving IC and the gold wires and hardened to protect the gold wires and the driving IC, thereby completing a primary assembly of the thermal print head. At this moment, it is necessary to check whether the electrical connections are made correctly or not. However, since the conventional thermal print head has a cavity formed by the heat sink at around the lower part of the connector insertion hole, when this area is pressed by a spring pin the thermal print head is apt to be overturned resulting in damage to the thermal print head. In the meantime, in case of the above mentioned conventional thermal print head, since the conductor formed on the electric wire is made very thin, it is necessary to use special jigs for checking the accuracy of the electrical connections without causing damage to the thermal print head. In order to check the accuracy of the electrical connections without using the special jig, the substrate which has the heating elements formed on the different type of the heat sink, and the PCB should be completely assembled. However, when manufacturing a thermal print head by using a boat according to the present invention, since the primary assembly of the thermal print head is a thin panel and the PCB has been already assembled, the accuracy of the electrical connections can be checked by use of a simple jig and further the jig can be readily standardized. Moreover, since the boat plays a role of the heat sink of the conventional thermal print head, the weight of the thermal print head can be decreased.

Referring again to FIG. 4, shown is a thermal print head according to the present invention, wherein the substrate 22 including the heating element 21 and individual electrode wires 26 formed thereon, and the PCB 24 including the driving IC 27 formed thereon are mounted on the boat 25.

Figure 5:
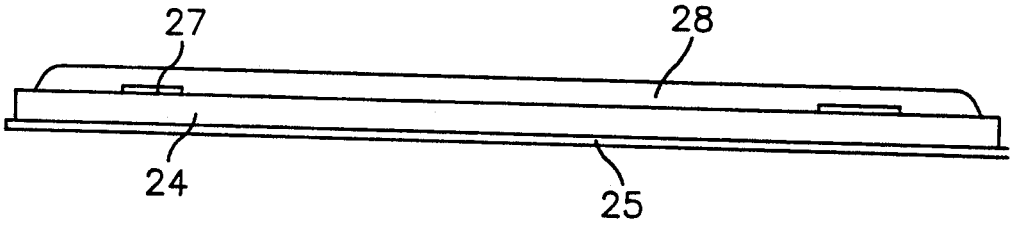
FIG. 5 shows a cross sectional view of the primary assembly of the thermal print head according to the present invention.

FIG. 5 shows a cross sectional view of the primary assembly of the thermal print head according to the present invention. The primary assembly will be mounted on the heat sink 29. It is shown in the drawing that the PCB 24 including the driving IC 27 formed thereon is mounted on the boat 25. The driving IC 27 and gold wires formed on the PCB 24 are protected by the silicon rubber 28 from the external environment.

Figure 6:
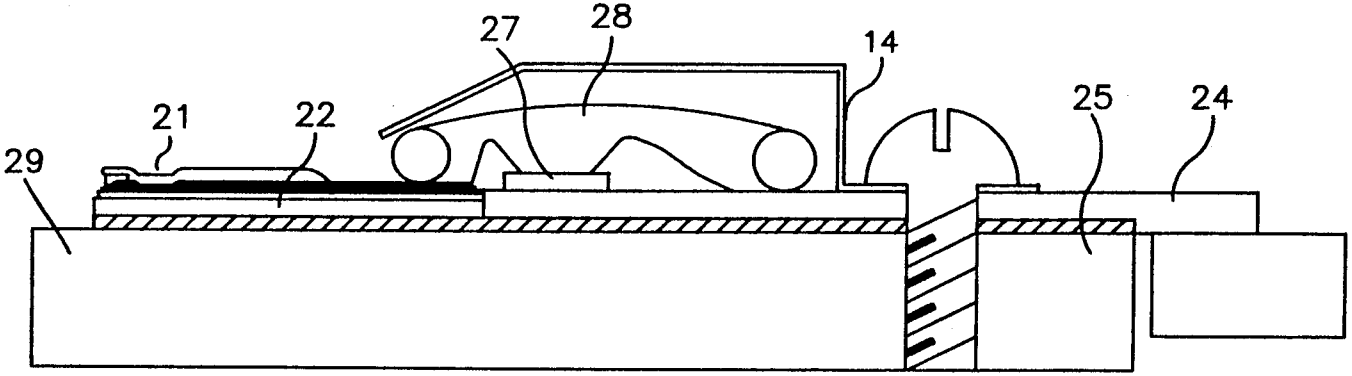
FIG. 6 shows a cross sectional view of a complete product of the thermal print head according to the present invention.

Referring to FIG. 6, there is shown a cross sectional view of the complete product of the thermal print head according to the present invention. It is well shown in the drawing that the primary assembly is mounted on the heat sink 29 to complete the manufacture of the device. In the drawing, the PCB 24 including the driving IC 27 formed thereon, the substrate 22 including the heating element 21 formed thereon and the protection cap 14 are finally mounted on the boat 25. Thereafter, the boat 25 is mounted on the heat sink 29 to complete the manufacture of the thermal print head according to the present invention.

It can be readily appreciated from the foregoing descriptions that a thermal print head can be manufactured easily regardless of the change of the material and shapes of the heat sink of a system by simply mounting the primary assembly according the present invention on the heat sink which material and shapes may be considerably changeable according to the mechanical change of the system. Therefore, the different types of the thermal print heads can be manufactured by the same process. Furthermore, the check on the electrical connections can be readily made by using a simple jig without damaging the thermal print head, and the primary assembly is a shape of a thin panel which is be very convenient for safe keeping.

The foregoing description shows only a preferred embodiment of the present invention. Various modifications are apparent to those skilled in the art without departing from the scope of the present invention which is only limited by the appended claims. Therefore, the embodiment shown and described is only illustrative, not restrictive.

What is claimed is:

1. A thermal print head, comprising:
- a substrate;
- a heating element mounted on said substrate;
- a printed circuit board;
- a driving integrated circuit mounted on said printed circuit board and connected to said substrate and said printed circuit board by conducting wires;
- a resinoid material covering said driving integrated circuit and said conducting wires;
- a boat performing as a first heat sink with said substrate and said printed circuit board mounted on said boat;
- a second heat sink, wherein said boat mounted on said second heat sink.

2. A process for making thermal print head, comprising:
- forming a heat element upon a substrate;
- mounting an integrated circuit for driving said heating element upon a printed circuit board;
- forming said substrate, integrated circuit and said printed circuit board on a boat, said boat serving as a first heat sink during said process of forming said substrate, integrated circuit and said printed circuit board on said boat;
- connecting said printed circuit board to said substrate with connecting wires;
- covering said integrated circuit and said conducting wires with a resinoid material; and
- mounting said board upon a second heat sink.

3. A thermal print head for covering electric information to thermal energy to record said electric information on a thermal recording medium, said thermal print head comprising:
- a substrate;
- a heating element mounted on said substrate for generating heat in response to a control signal;
- a printed circuit board for generating a driving signal in response to said electric information;
- a driving integrated circuit mounted on said printed circuit board and electrically connected to said substrate and said printed circuit board, for generating said control signal in response to said driving signal;
- a boat performing as a first heat sink, wherein said printed circuit board and said substrate are mounted on said boat to form an assembled unit;

a resinoid covering said driving integrated circuit and said electrical connections to said substrate and said printed circuit board, to protect said driving integrated circuit and said electrical connections; and a second heat sink, wherein said assembled unit is mounted on said second heat sink.

4. The thermal print head, as claimed in claim 3, further comprising:

a protection cap covering said driving integrated circuit and said electrical connections.

5. A method of making a thermal print head for converting electric information into thermal energy to record said electric information on a thermal recording medium, said method comprising:

mounting a heating element on a substrate;

mounting a driving integrated circuit on a printed circuit board;

mounting said substrate and said printed circuit board on a boat performing as a first heat sink, to form a unit;

connecting said driving integrated circuit to said substrate and said printed circuit board with conducting wire;

applying a resinoid to said driving integrated circuit and said conducting wires; and mounting said unit on a second heat sink.

* * * * *

UNITED STATES PATENT AND TRADEMARK OFFICE

CERTIFICATE OF CORRECTION

PATENT NO. : 5,329,298

DATED : July 12, 1994

INVENTOR(S) : Eun-Tak Hong, et al

It is certified that error appears in the above-indentified patent and that said Letters Patent is hereby corrected as shown below:

Column 3,

Line 13, after "covers" insert --the--;

Line 14, change "hardened" to --hardens--;

Line 32, change "type" to --types--; and change "sink" to --sinks--.

Column 4,

Line 35, after "boat" insert --is--.

Signed and Sealed this

Sixth Day of September, 1994

*Attest:*

Bruce Lehman

BRUCE LEHMAN

*Attesting Officer*

*Commissioner of Patents and Trademarks*